United States Patent [19]

Jewell

[11] 4,132,344

[45] * Jan. 2, 1979

[54] FOAM SANDWICH PACKAGE

[75] Inventor: Donald K. Jewell, Naperville, Ill.

[73] Assignee: Restaurant Technology, Inc., Oak Brook, Ill.

[ * ] Notice: The portion of the term of this patent subsequent to Jul. 6, 1993, has been disclaimed.

[21] Appl. No.: 717,485

[22] Filed: Aug. 25, 1976

Related U.S. Application Data

[63] Continuation of Ser. No. 577,998, May 16, 1975, abandoned.

[51] Int. Cl.[2] ..... B65D 1/34; B65D 5/66

[52] U.S. Cl. ..... 229/2.5 R; 150/0.5; 206/519; 220/4 B; 220/306; 229/44 R; 229/45 R

[58] Field of Search ..... 229/2.5 R, 2.5 EC, 29 M, 229/44 R, 44 EC, 45 R, 45 EC; 206/519, 520, 515; 220/4 E, 4 B, 4 F, 339, 306; 150/0.5

[56] References Cited

U.S. PATENT DOCUMENTS

| | | | |
|---|---|---|---|
| 3,217,963 | 11/1965 | Alsman | 229/2.5 EC |
| 3,292,810 | 12/1966 | Schecter | 220/4 E |
| 3,511,433 | 5/1970 | Andrews et al. | 229/44 R |
| 3,552,635 | 1/1971 | Martens | 229/45 EC |
| 3,687,350 | 8/1972 | Warburton | 229/45 EC |
| 3,786,982 | 1/1974 | Rakes et al. | 229/2.5 R |
| 3,851,789 | 12/1974 | Case et al. | 220/20 |
| 3,876,130 | 4/1975 | Haase | 229/2.5 R |
| 3,902,540 | 9/1975 | Commisso | 150/0.5 |
| 3,968,921 | 7/1976 | Jewell | 229/45 R |
| 3,984,027 | 10/1976 | Smith | 150/0.5 |

*Primary Examiner*—William Price
*Assistant Examiner*—Bruce H. Bernstein
*Attorney, Agent, or Firm*—Dressler, Goldsmith, Clement, Gordon & Shore, Ltd.

[57] ABSTRACT

A foam sandwich package having a dish section and a cover section and a latching mechanism comprising a forwardly projecting latching tongue extending into a latching aperture. The tongue is biased forwardly by the dish section and the aperture is formed in the cover portion. The dish section may be hingedly connected to the cover section, and score lines in the hinge section may be so arranged that they assist in maintaining a bias of the latching tongue forwardly.

2 Claims, 24 Drawing Figures

HEATER
SHEAR FORM SLOT AND FORM PART
PUNCH FROM WEB
SKELETON WEB

FOAM SANDWICH PACKAGE

This application is a continuation of U.S. application Ser. No. 577,998 filed May 16, 1975, now abandoned.

This invention relates to foam packages for containing and keeping hot fresh sandwiches in a hot, moist condition and protected against cooling.

The time and expense of packaging hot sandwiches, especially at a fast food restaurant, is quite substantial. Not only is it important to package such sandwiches rapidly and at a minimum of expense, so also is it important to provide packaging which will keep a sandwich hot and moist for as long as possible. This both benefits the store operator and the customer who may wish to keep the sandwich for some time before it is eaten.

At the present time, most hot sandwiches at fast food restaurants are wrapped in paper and are then bagged or boxed. Large or jumbo sandwiches are frequently surrounded by a collar and then boxed. Some restaurants have used foam packages for some sandwiches and various types of foam packages have been designed and developed for use in packaging hot sandwiches, such as hamburger sandwiches. The utilization of expanded polystyrene for sandwich packaging provides efficiencies in material use not possible with denser paper or solid plastic. This represents a very substantial reduction in raw materials with the attendant conservation of resources.

Thus, although the art has recognized some advantages in the use of foam packages for hot sandwiches, the cost of such packages and the deficiencies in the design of such packages has resulted in the continuing predominant use of paper, cardboard and paperboard packaging for hot sandwiches in fast food restaurants.

Some of the expense and some of the disadvantages of current foam packages derive from the methods by which such packages are made. Others derive from the complex and relatively unsatisfactory latching mechanisms which are used. Typical prior art efforts at the design of foam sandwich packages are illustrated by U.S. Pat. Nos. 2,845,104; 2,915,214; 3,511,433; 3,851,789 and 3,876,130. The packages of this invention provide an improved latching mechanism and improved temperature and humidity control for a contained hot sandwich. The improved method of this invention makes it possible to make the improved latching mechanism at lower cost and with greater efficiency.

In accordance with this invention, improved foamed sandwich packages and an improved method of making such packages are provided.

An improved foamed sandwich package of this invention comprises a lower dish section and an upper cover section for covering said dish section.

The dish section comprises a sandwich supporting floor and an upstanding peripheral side wall extending upwardly and outwardly from the floor to an upper peripheral wall edge. The floor is proportioned to support said dish section on a table surface. The cover section comprises a dome and a peripheral side wall extending downwardly and outwardly from said dome to a lower peripheral wall edge, said dome being proportioned to support said cover section on a table surface. The cover section defines a depending peripheral skirt circumscribing the major portion of the lower peripheral wall edge. When the cover section is juxtaposed with said dish section, the skirt embraces and circumscribes a major portion of the upper peripheral wall edge.

The package of this invention includes a latching mechanism for the dish and cover sections. The latching mechanism has at least one latching tongue on said dish section at a front portion of the dish side wall. The latching tongue projects forwardly of said front wall portion and lies in a plane substantially parallel to a plane of a table surface when the dish section is supported on a table surface. The latching mechanism further includes a complementary latching aperture defined by the cover section for each of the latching tongues. Each latching aperture opens laterally of the side wall of said cover section and is positioned adjacent said lower peripheral wall edge.

At the base of the latching aperture an outwardly projecting web is provided. The web is proportioned to underlie a latching tongue when the cover and dish sections are juxtaposed and latched. The front wall portion of said dish section is sufficiently resilient so that when it is pushed inwardly, the latching tongue will be retracted inwardly of the inner edge of the surfaces defining the latching aperture and so that, when it is released, it will bias the latching tongue outwardly through the latching aperture.

When the cover and dish sections are juxtaposed and latched, the latching tongue projects outwardly beyond the skirt and over a web. The lower dish section maintains an outward bias against the upper cover section at the latching mechanism, thereby to help maintain the latching mechanism in a latched condition and to help prevent accidental opening of the package.

The latching tongue preferably projects outwardly from the uppermost peripheral wall edge of said dish side wall and preferably merges with the side wall of the dish in a reinforcing strut.

The package may include integral hinge means for hingedly connecting said cover and dish sections at a rear side wall portion opposite the latching mechanism or may have at least two pairs of latching tongues and latching apertures, one at the front and one at the opposite rear side wall portion of said package.

The skirt and the upper peripheral wall edge portion define limited areas open to the atmosphere for the escape of steam from the interior of the package to prevent a hot sandwich in said package from becoming soggy while preventing the entry of so much ambient air that condensation in the package and excessive cooling of a contained sandwich occurs.

An improved method of forming an apertured cover section for a foamed sandwich package of this invention comprises the steps of providing a web of expandable foam material, heating the web to a temperature at which it will expand, positioning said heated web in a forming die between forming die members, and closing forming die members to define a cavity in which said web selectively expands to form a sandwich package cover section, the cover section having a dome, integral side wall portions extending downwardly and outwardly from the dome to a lower peripheral wall edge and a peripheral skirt at said lower peripheral edge.

As the forming die members are closing, a first die member surface lying parallel to the direction of closure of said die members is moved towards a second die member surface lying parallel to the direction of closure of the die members. The die member surfaces confront and are substantially coplanar when the die members are fully closed. As the die member surfaces move towards their confronting position, the web is sheared between those surfaces to define a laterally opening aperture in a wall portion of the cover adjacent a lower peripheral wall edge of the cover.

When the cavity is fully closed, the forming of the cover and dish sections is confined and the wall thicknesses are controlled by the matched die members and the part cools. Thereafter, the dies are opened. The formed cover and dish sections remain in the web and are transported to the trim station, then separated from the remainder of the web.

Further objects, features and advantages of this invention will become apparent from the following description and drawings, of which:

FIG. 1 is a schematic flow sheet of a process by which sandwich packages of this invention may be made;

FIGS. 2 and 3 are plan views taken substantially along the planes 2—2 and 3—3 of FIG. 1, respectively;

Figures 1, 2, 3, 4, 5:
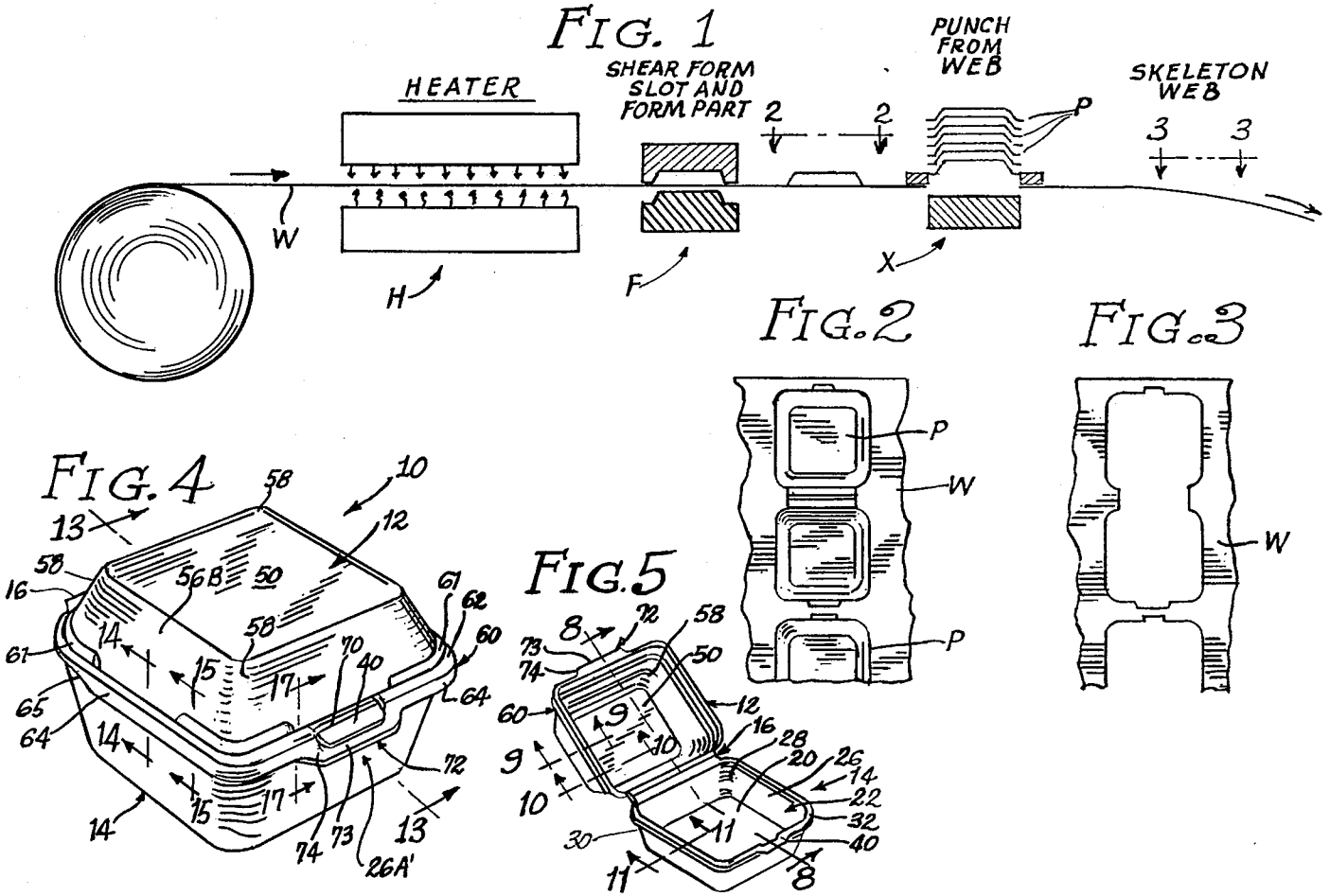
FIG. 4 is a perspective view of a sandwich package of this invention.
FIG. 5 is an open perspective view of the sandwich package of FIG. 4.
Figure 6:
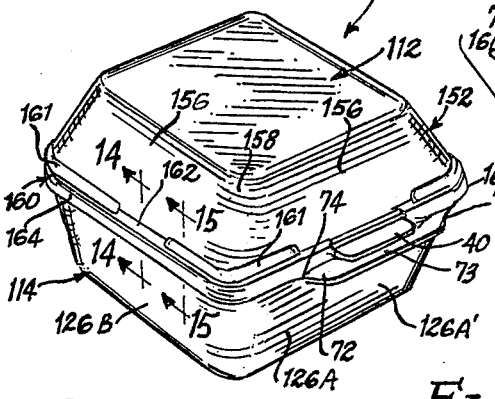
FIG. 6 is a perspective view of a further embodiment of a sandwich package of this invention.
Figure 7:
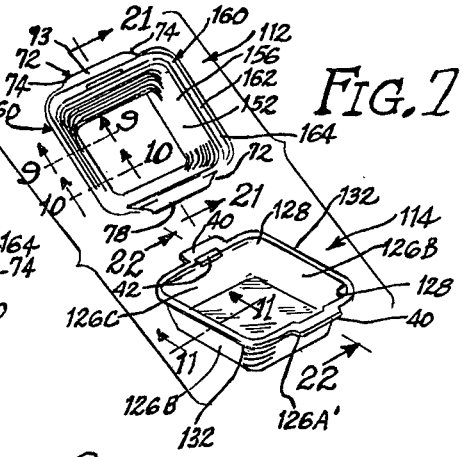
FIG. 7 is an open perspective view of the sandwich package of FIG. 6.
Figure 9:
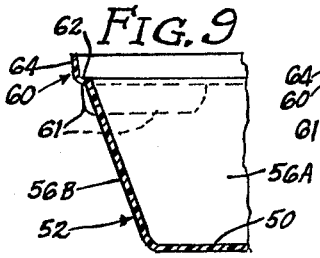
Figure 10:
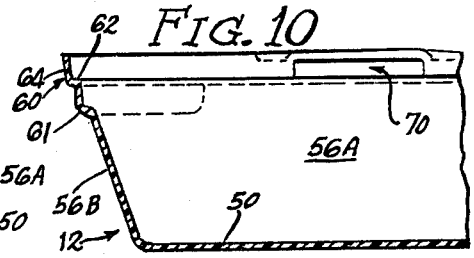
Figure 11:
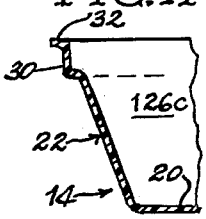
Figure 12:
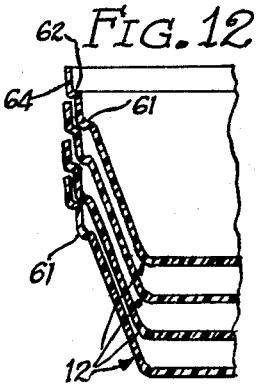
Figure 13:
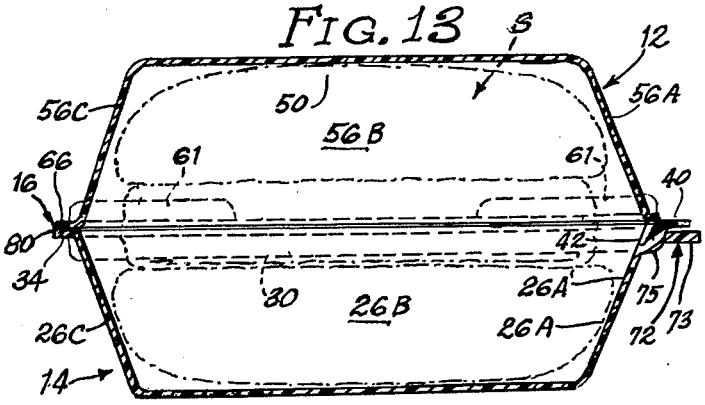
Figure 14:
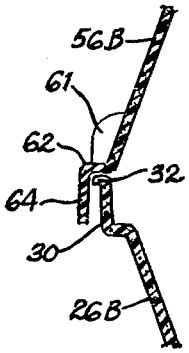
Figure 15:
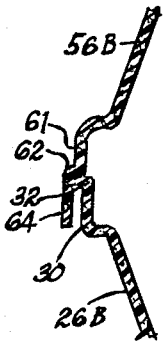
Figure 16:
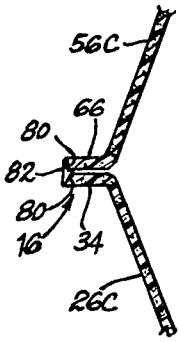
Figure 17:
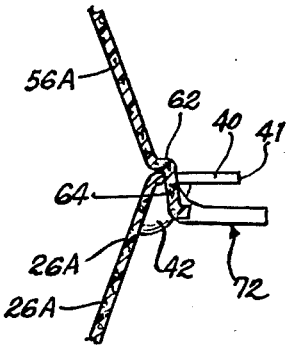
Figure 18:
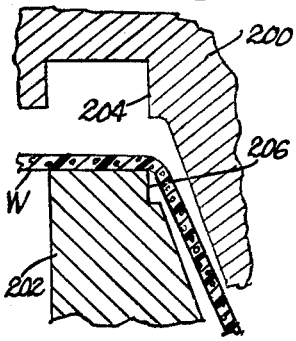
Figure 19:
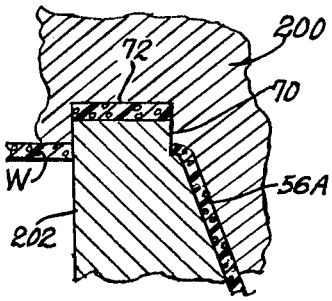
Figure 20:
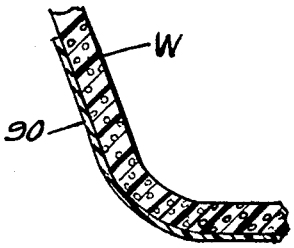
Figure 21:
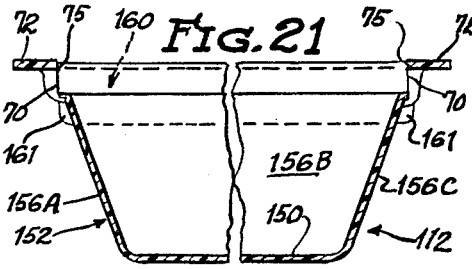
Figure 22:
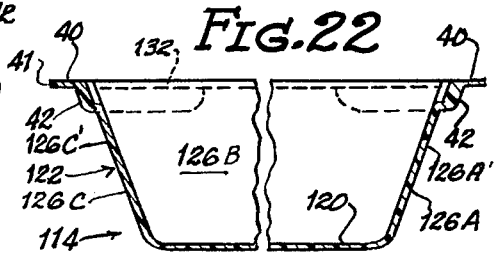
Figure 23:
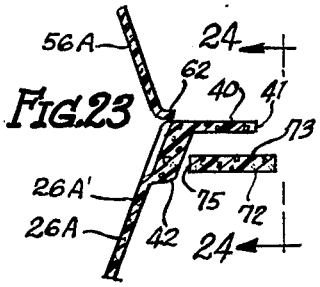
Figure 24:
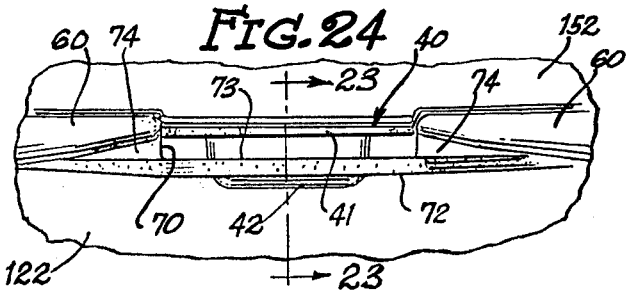

FIGS. 9, 10 and 11 are cross-sectional views taken substantially along the lines 9—9, 10—10 and 11—11, respectively, of FIGS. 5 and 7;

FIG. 12 is a fragmentary cross-sectional view, like that of FIG. 10, illustrating a plurality of sandwich packages stacked for shipment and use;

FIG. 13 is a cross-sectional view taken substantially along the line 13—13 of FIG. 4;

FIGS. 14 and 15 are cross-sectional views taken substantially along the lines 14—14 and 15—15, respectively, of FIGS. 4 and 6;

FIG. 16 is an enlarged fragmentary view of a portion of FIG. 13;

FIG. 17 is a cross-sectional view taken along the line 17—17 of FIG. 4;

FIGS. 18 and 19 sequentially illustrate the manner in which the locking aperture of the sandwich packages of FIGS. 4 and 6 is formed;

FIG. 20 is a cross-sectional view of a portion of a sandwich package having a surface coating;

FIGS. 21 and 22 are cross-sectional views taken substantially along the lines 21—21 and 22—22, respectively, of FIG. 7;

FIG. 23 is a cross-sectional view taken substantially along the lines 23—23 of FIG. 24; and FIG. 24 is a front elevational view taken substantially along the line 24—24 of FIG. 23.

Referring first to the foamed sandwich package 10 of FIGS. 4 and 5, package 10 comprises an upper cover section 12 and lower dish section 14. Package 10 is preferably of expanded polystyrene of the closed-cell type, thereby to provide excellent insulating characteristics. Sections 12 and 14 are hingedly connected via hinge section 16.

Dish section 14 comprises a sandwich supporting floor 20 and an upwardly and outwardly inclined peripheral side wall 22. In the embodiment illustrated, floor 20 is substantially square, with each of its four corners being gently rounded. Wall 22 comprises four wall portions 26 which merge in curved, sloping intersections 28.

Adjacent the upper peripheral edge of wall 22, thickened wall beads are provided. They may be formed in mated die members. Beads 30 commence at the upper edge of front wall portion 26A, continue around side wall portions 28B (which may be mirror images), and terminate in rear wall portion 26C. Wall beads 30 provide reinforcement and strength for the dish section 14 and also serve as stacking beads to provide for the easy and rapid denesting of a stack of sandwich packages 10. A typical stack is illustrated in fragmentary form in FIG. 12. A flange 32 projects laterally from the upper edges of wall portions 26A and 26B and beyond the underlying wall beads 30. A further flange portion 34 extends rearwardly from rear wall portion 26C and merges in hinge section 16.

Front wall portion 26A mounts a generally flat, blade-like bayonet locking tongue or latch 40. Locking latch 40 projects forwardly and outwardly from the uppermost edge of front wall portion 26A and is generally coplanar with flange 32. Latch 40 also lies in a plane which is substanstantially parallel to floor 20 and to the plane of a table surface when the dish section is supported on a table surface. Locking latch 40 is provided with an underlying reinforcing member or strut 42 which merges with the locking latch 40 and front wall portion 26A and which, in the embodiment illustrated, projects forwardly from wall portion 26A to strengthen and support locking latch 40.

It is to be noted that wall beads 30 terminate at wall portion 26A in laterally spaced relation to locking latch 40. This promotes the flexibility of the central area 26A' of front wall portion 26A when it is to be pressed inwardly the distance necessary to retract locking latch 40 to allow it to penetrate a complementary locking aperture in cover section 12.

Upper cover section 12 comprises a dome 50 and, when the package 10 is closed, as illustrated in FIG. 4, further comprises a downwardly and outwardly inclining peripheral wall 52. Dome 50 is substantially square, with each of its four corners being gentle rounded. Peripheral wall 52 comprises four wall portions 56 which merge in curved, sloping intersections 58.

Adjacent the lower edge of peripheral wall 52, a depending sealing skirt 60 is provided. It circumscribes the major portion of the lower peripheral wall edge. Sealing skirt 60 comprises an outwardly and downwardly curved shoulder 62 and a downturned flange 64. Shoulder 62 is dimensioned and proportioned to overlie flange 32. Downturned flange 64 depends far enough to embrace flange 32 and a major portion of the upper edge of the upper peripheral edge of wall 22, and to extend therebelow. Sealing skirt 60 extends from the front wall portion 56A to near the rear of side wall portions 56B (which may be mirror images) at each side. Stacking beads 61 provide for easy and rapid denesting of a stack of sandwich packages 10.

Sealing skirt 60 serves both suitably to seal the package 10 against the entry of cooling air to prevent internal condensation and excessive cooling, to retain the heat in the sandwiches, and to help regulate the amount of steam which escapes from the package 10. However, to prevent the complete sealing of the cover and dish sections 12 and 14, so that some moisture may escape from a closed package 10, the rear portions 65 of flange 64 slope upwardly toward hinge section 16, thereby to provide an area open to ambient atmosphere through which moisture may escape from the package. Further, skirt 60 and flange 30 are so proportioned that some steam may escape between them from the interior of the package 10, thereby to prevent sandwiches from becoming soggy. A hinge segment 66 extends rearwardly from rear wall portion 56C and substantially overlies flange portion 34. It merges in hinge section 16.

Front wall portion 56A of cover section 12 defines a locking aperture 70 which opens and faces forwardly of the cover section 12 and laterally of side wall 52. Aperture 70 is proportioned to receive locking latch 40, thereby to provide a latching mechanism for package 10. Locking aperture 70 terminates at its sides in sealing skirt 60 and is at least as wide as latch 40 which it is to receive. It is bordered at its top by shoulder 62. Lower web 72 serves to define the base of locking aperture 70. Web 72 is joined to sealing bead 60 at its sides. Web 72 extends outwardly of the side wall of cover 12 and is generally flat and, in plan view, comprises an expansive central portion 73 which lies in a plane generally parallel to the plane of dome 50. At its sides it terminates in fillets 74 which slope rearwardly laterally and upwardly and which merge in sealing skirt 60 (see FIGS. 4, 23 and 24). The areas in which the web 72 merge in the wall portion and skirt 60 are of increased thickness to provide enhanced strength, thereby to resist tearing, breaking and flexing of the web 72 from its connection with cover section 12. Web 72 is preferably thicker than is the main body of cover section 12.

Figure 8:
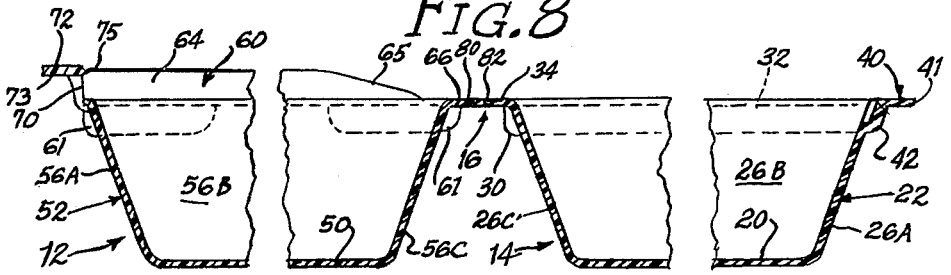
FIG. 8 is a cross-sectional view taken substantially along the line 8—8 of FIG. 5.

When the package 10 is to be closed, i.e., to be manipulated from a position like that of FIGS. 5 and 8 to the juxtaposed closed position of sections 12 and 14 illustrated by FIGS. 4 and 14, such as to enclose a hamburger sandwich S (see FIG. 13), the cover section 12 is swung forwardly about the hinge section 16 to a position in which web 72 confronts locking latch 40. At that time, locking latch 40 is retracted by pushing against resilient central area 26A' until the forward edge 41 of the locking latch is retracted to a position behind and inwardly of the innermost edge 75 of web 72 and the surfaces defining the locking aperture. At that time, the cover section 12 is pushed downwardly until the sealing skirt 60 surrounds flange 32 and embraces the upper edges of wall 22. Then, when pressure against central area 26A' is relieved and released, the locking latch 40 moves forwardly into and outwardly through locking aperture 70. The latch edge 41 projects outwardly beyond skirt 60 and over web 72. Web 72 helps prevent the cover section from collapsing downwardly over the dish section by serving to provide a support or bearing surface against which latch 40 acts to prevent relative downward movement of the cover section thereof.

It should be observed that hinge section 16, in the preferred embodiment illustrated, includes a pair of score or hinge lines which border hinge segments 34 and 66. These define a central hinge segment 82 which, when the sandwich package 10 is brought to the closed position of FIG. 4, tends to act against adjacent portions of flange 34 and segment 66, thereby to bias the dish and cover sections toward an open position, such as that of FIG. 5. Accordingly, when the latching mechanism of the sandwich package is released, the sections 12 and 14 will tend to spring outwardly to an open position. Depending upon the package dimensions and hinge arrangement, the cover section may swing about hinge section 16 to position in which the floor 20 and dome 50 will lie in a common plane upon a table surface, or the like. It should be noted that hinge section 16 is almost as wide as the package 10. The greater the width, the more stable is the package 10. The depth of hinge segments 34 and 66 is substantial also. This also promotes stability of package 10 and facilitates closing of the package.

The hinge section 16 and package 10 are proportioned to promote a biasing of the dish section 14 forwardly relative to cover section 12. Accordingly, hinge flange segment 66 may preferably be slightly shorter in cross-section, as seen in FIG. 16, than is flange portion 34 thereby to thrust dish section 14 and its associated locking latch 40 forwardly, more securely to maintain the latching connection between latch 40 and aperture 70. This bias helps to maintain the latch against accidental opening when jarring forces or pressures might tend to cause the latch 40 to retract. It will be apparent that the latching mechanism of package 10 is both certain and secure and easy to latch and unlatch, as distinct advantages to the package of this invention.

In most respects, the embodiment of FIGS. 6 and 7 is quite like that of FIGS. 4 and 5. The major difference is the fact that sandwich package 100 is a two-piece package rather than a hinged, two-section package. Thus, there is no hinge section present in package 100 and the package 100 is closed by a pair of latching mechanisms of the type described in connection with package 10.

The embodiment of FIGS. 6 and 7 will be described with special reference to FIGS. 6, 7, 21 and 22. It will be appreciated, however, that the sectional views 9, 10, 11, 14 and 15 are common to the embodiments of FIGS. 4 and 6, that the stacking illustrated in FIG. 12 is typical of stacking with the embodiment of FIG. 6, that the forming of the locking aperture illustrated by FIGS. 18 and 19 is common to both embodiments and that the showings of the latching mechanism of FIGS. 17, 23 and 24 are common to both embodiments. Wherever feasible, common part numbers have been used.

Referring now to the sandwich package 100 of FIGS. 6 and 7, package 100 comprises a cover section 112 and a dish section 114. It may also be made of expanded, close-celled polystyrene.

Dish section 114 comprises a floor 120 and an upwardly and outwardly inclined peripheral wall 122. In the embodiment illustrated, floor 120 is substantially square, with each of the four corners being slightly rounded. Wall 122 comprises four wall portions 126 which merge in curved, sloping intersections 128.

Adjacent the upper peripheral edge of wall 122, thickened or formed wall beads, like beads 30, are provided. These beads commence at the upper edge of front wall portion 126A, continue around side wall portions 126B (which are mirror images) and terminate in rear wall portion 126C, which in this embodiment is identical to front wall portion 126A. These wall beads, like beads 30, provide reinforcement and strength for the dish 114 and also serve as stacking beads to provide for the easy and rapid denesting of a stack of dish sections 114. A flange 132 projects laterally from the upper inner edge of wall portions 126A, 126B and 126C and beyond the underlying wall beads.

Wall portions 126A and 126C mount generally flat, blade-like bayonet locking tongues or latches 40. Locking latches 40 project forwardly and outwardly from the uppermost edges of front and rear wall portions 126A and 126C and are generally coplanar with flange 132. Latch 40 also lies in a plane which is substantially parallel to floor 120. Each locking latch 40 is provided with an underlying reinforcing member or strut 42 which merges with a latch 40 and a wall portion and which projects forwardly from each wall portion 126A and 126C to strengthen and support its associated locking latch 40.

It is to be noted that wall beads 130 terminate at wall portions 126A and 126C in laterally spaced relation to locking latches 40. This promotes the flexibility of the central areas 126A' and 126C' of front and rear wall portion 126A and 126C when one or the other is to be pressed inwardly the distance necessary to retract locking latches 40 to allow them to penetrate the complementary locking apertures in cover section 112.

Upper cover section 112 comprises a dome 150 and, when the package 100 is closed, as illustrated in FIG. 6, further comprises a downwardly and outwardly inclining peripheral wall 152. Dome 150 is substantially square, with each of the four corners being gently rounded. Peripheral wall 152 comprises four wall portions 156 which merge in curved, sloping intersections 158.

Adjacent the lower edge of peripheral wall 152, depending sealing skirts 160 are provided. Sealing skirts 160 each comprise an ouwardly and downwardly curved shoulder 162 and a downturned flange 164. Shoulder 162 is dimensioned and proportioned to overlie flange 132. Downturned flanges 164 depend far enough to embrace flange 132 and a major portion of the upper edge of the upper peripheral edge of wall 122 and to extend therebelow. Sealing skirts 160 extend from near the center of the front wall portion 156A, around a side wall portion 156B to near the center of the rear wall portion 156C. Front wall and rear wall portions 156A and 156C are identical. Stacking beads 161 provide for easy and rapid denesting of a stack of sandwich packages 100. Sealing skirts 160, like skirt 60, serve suitably both to seal the package 100 against the entry of cooling air and to help regulate the amount of steam which escapes from the package 100. To prevent the complete sealing of the cover and dish sections 112 and 114, so that some moisture may escape from a closed package 100, beads 160 and flanges 132 are suitably spaced.

Each of the front and rear wall portions 156A and 156C of cover section 112 defines a locking aperture 70 which faces and opens outwardly of the package 100 and laterally of wall 152, and which is proportioned to receive a locking latch 40. Locking aperture 70 terminates in its sides in sealing skirts 160. It is bordered at its top by a shoulder 162. A lower web 72 serves to define the base of locking aperture 70 and is joined to sealing skirts 160 at its sides. Web 72 is generally flat and, in plan view, it comprises an expansive central portion 73, which lies in a plane generally parallel to the plane of dome 150. At its sides it terminates in fillets 74 which slope rearwardly laterally and upwardly and which merge in sealing skirts 160. In the areas in which the webs 72 merge with the wall portion and skirts 160, they are of increased thickness to provide enhanced strength, thereby to resist tearing, flexing and breaking of the web 72 from its connection with cover section 112. Web 72 is thicker than is the main body of cover section 112.

When the package 100 is to be closed, i.e., to be manipulated from a position like that of FIG. 6 to the juxtaposed closed position of sections 112 and 114 illustrated by FIG. 7, the dish section 114 is grasped and squeezed in resilient central areas 126A' and 126C' until locking latches 40 are retracted sufficiently to allow the cover section to be moved downwardly to a position in which forward edges 41 are spaced inwardly of innermost edges 75. Then, when pressure against central areas 126A' and 126C' is released, the locking latches 40 move forwardly into and outwardly through locking apertures 70 to cause package 100 to remain closed. The latch edges 41 project outwardly beyond skirts 160 and over webs 72.

Alternatively, one latch 40 may be inserted in its aperture 70 and the opposite central area squeezed and the package closed as was described in connection with the embodiment of FIG. 4.

The package 100 is proportioned to promote a biasing of the latches 40 outwardly relative to cover section 112. This outward biasing helps to maintain the latching mechanism against opening when jarring forces or pressures might tend to cause the latches 40 to retract from apertures 70.

Referring now to FIG. 20, that illustrates a package in accordance with this invention in which the foam package is provided with a thin plastic skin or film laminated to it. Considering FIG. 20 as a fragmentary portion of a cover section 12 or dish section 14 of package 10, a film 90 may be laminated to a foam web W prior to processing as illustrated by FIG. 1. The film 90 may be preprinted or decorated in any suitable fashion. By utilizing a suitably decorated film 90, a wide variety of different appearances may be given to packages made in accordance with this invention. Of course, it is apparent that the surface of the foam itself may be embossed, printed or otherwise treated to provide a wide variety of desired decorative appearances.

Referring now to FIGS. 1 to 3, 18 and 19, a process by which foam packages in accordance with this invention may be made is schematically shown. A suitable supply of an expandable foamed polystyrene sheet material is provided as a continuous web W. Web W is carried through a heating station H by a conveyor (not shown) where it is heated to a temperature at which the foam begins to soften and expand. From the heating station H, web W is conveyed to and positioned in a forming station F in which it is suitably formed into the desired package shape by suitable matched dies. Several such packages may be formed across the width of web W. The web W, as formed, is illustrated by FIG. 2.

From station F, the formed web is carried to a punching station X where suitable punching dies sever and separate the packages P from the web. The packages may be suitably stacked, as by punching them out upwardly, where stacks of packages P grow and are removed as desired. The remaining skeleton of web W, as illustrated by FIG. 3, is then carried away to waste for recycling or disposal.

The forming dies at forming station F may be generally in accordance with the prior art. They are constructed to shape the heated web and to confine and control its growth as desired.

In accordance with this invention, the dies, as illustrated in section by FIGS. 18 and 19, are configured to form packages 10 and are specially configured to form a locking aperture 70 during the forming operation by shear forming, rather than by a punching or cutting process or by another secondary operation. As seen in FIG. 18, as die members 200 and 202 progressively move from the open position of FIG. 1, they approach the position of FIG. 18. At that time, a first portion of die 200 contacts the web W at what will become the rearward edge of web 72. As the dies continue to close, web W is sheared at that edge to sever web 72 from the main body of web W. As the die members 200 and 202 continue to move relatively toward each other, in the direction of closure, i.e., toward the closed position of FIG. 19, a first die surface 204 lying parallel to the direction of closure of the dies moves towards a second die surface 206 also lying parallel to the direction of closure. Surface 204 then moves into engagement with web W and shears and locally crushes the web as surface 204 moves relatively to die surface 206. When the dies are fully closed (FIG. 19) the aperture is formed and surfaces 204 and 206 are coplanar and contact and confront each other along a plane which, when the dies are reopened, defines a locking aperture 70 in a wall portion of a cover section adjacent a lower peripheral wall edge, which aperture opens laterally of the wall portion. As such, locking aperture 70 is formed at the time the package P is formed without a separate or secondary operation, thereby minimizing the time and expense inherent in post-registration in otherwise providing that slot. After the dies have closed, the remaining portions of the cavities defined by the dies for the respective cover and dish sections are appropriately filled by the formed and expanded foam web W. Portions of the cavities are illustrated by those cavity portions in which web 72 and wall portion 56A are finally selectively expanded to their predetermined dimensions. As will be appreciated, the expansion varies depending upon the dimensions and characteristics desired. For example, as seen in FIG. 19, the cavity for web 72 is wider than that for wall portion 56A. Of course, the cavity will confine the growth of the web to the dimensions of the closed cavity. Following the forming operation, the dies are opened and web W and the formed sections of a package are conveyed to successive stations.

It is to be observed that the formed aperture 70 is an opening which is formed in the dies and not by a punching operation or by another secondary operation and not by a surface lying perpendicular to the direction of movement of the dies as they close. Rather, aperture 70 is formed as the dies close to define the forming cavity by surfaces which lie in planes which are substantially parallel to the direction of movement of the dies as they close, and by a shearing operation. That is important both to the ultimate use of the product, i.e., the provision of a latch receiving aperture which can receive a horizontal latching member, and to the ease and efficiency of providing an opening so oriented without a secondary operation either within the dies or at a separate station. To form such an opening to be so positioned relative to the main body of a product in the past, it has generally been considered necessary to form such openings by a secondary operation, either in the dies themselves or at a separate station.

The sandwich packages described herein provide a number of important features and advantages. They are lightweight and compact and are easily stacked and separated. The dish sections can be used as a compartment in which to build a sandwich, thereby eliminating the necessity of transferring a sandwich, once made, into a package, and further eliminating the necessity of separately wrapping the sandwich. The skirt structure depending from the cover and embracing the upper surface of the dish section serves to control heat retention and to permit steam to escape, thereby to minimize condensation in the package and the tendency to sogginess of a packaged sandwich. The skirt structure also provides a finished and attractive appearance to the packages, as compared to prior art structures in which coplanar flanges expose the interior of the package to view.

The dish section is constructed so that the locking latches have an outward bias relative to the locking apertures in the cover section, thereby to minimize the likelihood of the unwanted retraction of the latches from the apertures when jarring forces are encountered. The manner of unlocking the locking mechanism is self-apparent to the user, meaning that no instruction of the user is required for him to gain access to the sandwich in the package. It is also important that the latches be on the base section and that the locking apertures be in the cover section so that, if the package is grasped by the cover and squeezed, it is not inadvertently unlatched.

The generally square formation of the packages, for sandwiches which are round, as are most sandwiches served on buns, promotes ease of removal of the sandwiches from the packages because of the finger space provided at the corners of the floor.

The packages are, of course, reusable and may be opened and closed many, many times. The cover section may be used, while dining on the sandwich, as a secondary food container, such as for french fries or the like. Although it is not necessary, the depth of the dish and cover sections 12 and 14, where hinged together, may preferably be about the same so that both will sit flat on a table or the like when both are to be used. The packages may also be used for secondary purposes by customers, such as for toys and for hobby and craft activities.

The foregoing description and drawings will suggest modifications to those skilled in the art. Accordingly, the invention is intended to be limited only in accordance with the claims, and not be the particular embodiments of the invention herein disclosed.

What is claimed is:

1. A foam sandwich package comprising: a lower dish section and an upper cover section for covering said dish section, said dish section comprising a supporting floor and an upstanding peripheral side wall extending upwardly and outwardly from the floor to an upper peripheral wall edge, said floor being proportioned to support said dish section on a table surface, said cover section comprising a dome and a peripheral side wall extending downwardly and outwardly from said dome to a lower peripheral wall edge, said dome being proportioned to support said cover section on a table surface, said cover section defining a depending peripheral skirt circumscribing the major portion of said lower peripheral wall edge and which skirt, when said cover section is juxtaposed with said dish section, embraces and circumscribes a major portion of said upper peripheral wall edge, a latching mechanism for said dish and cover sections comprising at least one rigid latching tongue, said tongue laterally extending from said dish section at a front portion of said dish side wall, said latching tongue projecting forwardly of said front wall portion and lying in a plane substantially parallel to the plane of a table surface when said dish section is supported on a table surface, and said latching mechanism further comprising a complementary latching aperture defined in the side wall of said cover section for each said latching tongue, each said latching aperture opening laterally of the side wall of said cover section and being positioned adjacent said lower peripheral wall edge and having a width at least as great as the width of the latching tongue, a web at the base of the latching aperture and projecting the outwardly of said cover side wall and being proportioned to underlie a latching tongue when said cover and dish sections are juxtaposed and latched, said front wall portion of said dish section including a resilient portion generally beneath said latching mechanism which when pushed inwardly allows the latching tongue to be retracted inwardly of the inner edge of the surfaces defining said latching aperture and then, when released, biases the latching tongue outwardly through the latching aperture, and wherein a said latching tongue, when said cover and dish sections are juxtaposed and latched, projects outwardly beyond the skirt and over a said web, and wherein said lower dish section maintains an outward bias against the upper cover section at the latching mechanism, thereby to help maintain the latching mechanism in a latched condition and to help prevent accidental opening of the package, and in which said latching tongue and said front wall portion merge in a reinforcing strut.

2. A foam sandwich package comprising: a lower dish section and an upper cover section for covering said dish section, said dish section comprising a supporting floor and an upstanding peripheral side wall extending upwardly and outwardly from the floor to an upper peripheral wall edge, said floor being proportioned to support said dish section on a table surface, said cover section comprising a dome and a peripheral side wall extending downwardly and outwardly from said dome to a lower peripheral wall edge, said dome being proportioned to support said cover section on a table surface, said cover section defining a depending peripheral skirt circumscribing the major portion of said lower peripheral wall edge and which skirt, when said cover section is juxtaposed with said dish section, embraces and circumscribes a major portion of said upper peripheral wall edge, a latching mechanism for said dish and cover sections comprising a first rigid latching tongue, said tongue laterally extending from said dish section at a front portion of said dish side wall, said latching tongue projecting forwardly of said front wall portion and lying in a plane substantially parallel to the plane of a table surface when said dish section is supported on a table surface, and said latching mechanism further comprising a complementary latching aperture defined in the side wall of said cover section for said latching tongue, said latching aperture opening laterally of the side wall of said cover section and being positioned adjacent said lower peripheral wall edge and having a width at least as great as the width of the latching tongue, a web at the base of the latching aperture and projecting outwardly of said cover side wall and being proportioned to underlie a latching tongue when said cover and dish sections are juxtaposed and latched, said front wall portion of said dish section including a resilient portion generally beneath said latching mechanism which when pushed inwardly allows the latching tongue to be retracted inwardly of the inner edge of the surface defining said latching aperture and then, when released, biases the latching tongue outwardly through the latching aperture, and wherein a said latching tongue, when said cover and dish sections are juxtaposed and latched, projects outwardly beyond the skirt and over a said web, and wherein said lower dish section maintains an outward bias against the upper cover section at the latching mechanism, thereby to help maintain the latching mechanism in a latched condition to help prevent accidental opening of the package, and in which said latching mechanism comprises a second rigid latching tongue and a second latching aperture at the opposite rear side wall portion of said package, and further comprising reinforcing struts merging with each latching tongue and the adjacent side wall portion for strengthening said latching tongues.

* * * * *

UNITED STATES PATENT AND TRADEMARK OFFICE

CERTIFICATE OF CORRECTION

PATENT NO. : 4,132,344

DATED : January 2, 1979

INVENTOR(S) : Donald K. Jewell

It is certified that error appears in the above-identified patent and that said Letters Patent are hereby corrected as shown below:

In the Disclaimer Notice, correct it to read:

-- The portion of the term of this patent subsequent to July 13, 1993 has been disclaimed. --

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*